US006445333B1

(12) United States Patent
Tanaka

(10) Patent No.: US 6,445,333 B1
(45) Date of Patent: Sep. 3, 2002

(54) RADIO CONTROL DEVICE FOR MODEL VEHICLE

(75) Inventor: Masahiro Tanaka, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/340,013

(22) Filed: Jun. 28, 1999

(30) Foreign Application Priority Data

Jul. 8, 1998 (JP) ..... 10-193317

(51) Int. Cl.[7] ..... G08C 19/00

(52) U.S. Cl. ..... 341/176; 341/173; 340/825.69; 340/825.72; 375/239; 244/190

(58) Field of Search ..... 341/173, 176; 375/239, 238; 340/825.69, 825.72; 244/190

(56) References Cited

U.S. PATENT DOCUMENTS 4,072,898 A * 2/1978 Hellman et al. ..... 340/825.69
4,091,328 A * 5/1978 Hellman et al. ..... 340/825.69
4,739,311 A * 4/1988 Yamamoto et al. ..... 341/176
4,929,949 A * 5/1990 Yamamoto ..... 341/176
5,087,000 A * 2/1992 Suto ..... 244/189
5,280,634 A * 1/1994 Aneha ..... 340/825.72
5,461,373 A * 10/1995 Yamamoto et al. .... 340/825.69
5,751,237 A * 5/1998 Tanaka ..... 341/176

* cited by examiner

*Primary Examiner*—Michael Horabik
*Assistant Examiner*—Albert K. Wong
(74) *Attorney, Agent, or Firm*—Oblon, Spivak, McClelland, Maier & Neustadt, P.C.

(57) ABSTRACT

A redio control device suitable for model aircraft is provided that can quickly correct the rudder following the operation of a stick lever even during a delay operation, so that the manipulated body can be stably controlled according to the operator's direction. The trim switch 8 that can vary the servo output of the servo device for each channel to the neutral position of each of the levers 7A and 7B of the stick unit 7 is provided to the transmitter 2. The arithmetic process means 4 stores plural types of characteristic data representing the servo output to the operation amount of each of the levers 7A and 7B changeable by the changeover switch 8. When the lever 7A (or 7B) is not operated over a set value and when the changeover switch 9 selects the characteristic data corresponding to the operational status of the manipulated body 1, the arithmetic process means 4 delays the operation by the offset of the mixing amount due to the trim switch 8. When the lever 7A (or 7B) is operated over a set value during a delay operation, the arithmetic process means 4 interrupts the delay operation and outputs the servo output of the characteristic data corresponding to the operation amount of the lever 7A (or 7B).

9 Claims, 9 Drawing Sheets

RADIO CONTROL DEVICE FOR MODEL VEHICLE

BACKGROUND OF THE INVENTION

The present invention relates to a radio control device that remotely controls bodies manipulated according to the operation amount of a stick lever by wireless. More particularly, the present invention relates to a radio control device for model aircraft and suitable to remotely control by radio a helicopter acting as a manipulated body of which the servo output is different between hovering and a flight in the air.

In the radio control device that controls manipulated bodies including model automobiles, model motor boats, model airplanes, model helicopters, or the like by wireless, the resistance value of a variable resistor is controllably varied by operating the stick lever. Thus, a frame signal with a fixed length (serial signals in a base band for each channel) is produced as a control signal. The control signal is modulated with high-frequency carriers. Then the transmitter generates high-frequency modulated control signals. The receiver mounted on the manipulated body receives radio waves output from the transmitter, demodulates them, and then separates the demodulated signal into data for each channel. In order to control the velocity, direction and attitude of the manipulated body, the respective movements of various types of servo units on the manipulated body are varied according to the data.

A trim switch is provided on the transmission side to adjust the servo output of a servo unit mounted on the manipulated body by varying the resistance value of the variable resister to the neutral position where the stick lever is not operated.

When the manipulated body is remotely controlled through the operation of a stick lever of the transmitter is a helicopter, the throttle servo operation amount characteristics, the pitch servo operation amount characteristics (such as throttle curve, pitch curve, or pitch to rudder mixing) to the stick lever, and the position of the the switch are different in a hovering state and in a flight state.

As shown in FIGS. 6(*a*), 6(*b*), 7(*a*), 7(*b*), 8(*a*) and 8(*b*), the servo output of a throttle servo unit to the stick lever and the servo output of a pitch servo unit to the stick lever in a hovering state and in a flight state (in a loop, stall turn, or roll performance in the air) are previously stored as data on the transmitter side.

When a manipulated body is remotely controlled, plural servo units are often operated with a single stick lever (that is, the mixing operation is performed). For example, when the manipulated body is a helicopter, the throttle servo unit, the pitch servo unit for the main rotor, and the pitch servo unit for the tail rotor are operated using one stick lever.

As shown in FIGS. 6(*c*), 7(*c*) and 8(*c*), the servo output of the servo unit for the pitch to rudder mixing to the stick lever is differently stored in a hovering state and a flight state. The trim switch is operated to the trim position matching a flight state to set the mixing amount suitable for a hovering state and flight state.

In order to remotely control a manipulated body, the changeover switch can selectively set data suitable for each flight state on hovering and in flight in the sky.

When the servo units operate immediately after the switching of the changeover switch, the servo output changes by the offset of the mixing amount of the trim switch, so that the attitude of the body of the aircraft may change quickly.

The transmitter has the delay function of operating the servo unit at a rate slower than the operation rate of the main body to the original position to be returned after the changeover switch is switched. In this case, the delay function means that the servo unit is operated at a rate slower than the original operational rate to the position where the servo unit must reach to prevent the attitude of an aircraft from being sharply changed.

When the operation due to the delay function is ended, the servo unit returns to the normal operation and then immediately operates according to the operation of the stick lever.

Even when the manipulated body is an airplane, the elevator may have a delay function to prevent the attitude disturbance caused by an air brake operated.

Conventionally, in order to execute the delay function, there are the case where the delay operation is functioned by the operation amount of a stick lever plus an offset of a mixing amount due to the trim switch at the switching time of the changeover switch, and the case where the delay operation is functioned by only the offset of a mixing amount due to the trim switch at the switching time of the changeover switch. The operation of the servo unit can be set to a desired delay amount.

FIG. 9 is an operational flow chart illustrating the case where the operation is delayed by an offset of a mixing amount due to a trim switch at the switching time of the changeover switch. The process according to the flow chart shown in FIG. 9 is executed every one fame (e.g. 30 msec).

First, the presence or absence of switching of the changeover switch is detected to select a set value agreed with a flight condition (ST51). When the changeover switch is switched (ST51-Yes), the variation amount buf of the servo unit during a delay operation is cleared to zero (ST52). Thereafter, the counter initial value (movement amount) cnt corresponding to a delay amount is set (ST53). The counter initial value cnt is calculated by the formula $CNT_{MAX}\times(rate/100)$, where $CNT_{MAX}$ is a count starting value with a delay amount of 100% and rate is the rate of a delay amount.

Next, offset mixing data old (a mixing amount of the trim switch) prior to one frame is set to the position sta of the servo unit at the delay starting time (ST54). The position sta is subtracted from the offset mixing data ofs. Then, the resultant difference is set as a servo movement amount mov to be delayed (ST54).

Next, the remaining movement amount of a servo unit is calculated based on the difference between a current position and a target position of the servo unit. In the flow chart of FIG. 9, the formula, (mov−buf)/cnt+buf, is calculated, where cnt is an initial value of a counter, mov is a movement amount of a servo unit delay-operated, and buf is a movement amount of a servo unit in a delay operation. The resultant value is set to the movement amount buf (ST55).

The remaining movement amount buf of a servo unit is added to the movement amount sta of the servo unit at the beginning of a delay operation. The trim amount trm is subtracted from the added value. The obtained value is set as a mixing amount mix (ST56). Thereafter, the initial value cnt of the counter is decremented by 1 (ST57). Thus, one frame process is completed.

In the above operation, if there is no changeover of the switch (ST51-No), it is judged whether the counter initial value cnt is 0, that is, the delay operation has been completed (ST58). If the counter initial value cnt is not 0 (ST58-No), the flow goes to the step ST55. If the counter initial value cnt is 0 (ST58-Yes), the offset mixing data ofs is set to the offset mixing data (old) as offset mixing data prior to one frame and is output as the mixing amount mix (ST59).

The mixing amount mix is added to the stick operation amount stk and the trim operation amount trm. Then, the added value is output to the servo unit as the servo operation amount srv. In the above-mentioned system, the delay operation is performed by calculating a stick operation amount plus a delay amount, in addition to an offset to a mixing amount due to a trim switch at the switching time of the changeover switch. However, when a stick lever is operated during a delay operation, correction of the rudder is delayed because the delay operation is continued even if an operator tries to quickly correct the rudder using a stick lever. Hence, this system has the problem in that a manipulated body cannot be arbitrarily controlled.

Moreover, according to the flow chart of FIG. 9, the system performs the delay operation by calculating a delay amount corresponding to only the offset amount of the mixing amount due to the trim switch at the switching time of the changeover switch. In this system, when a stick lever is operated during a delay operation, the servo unit is operated at a normal rate by the operation component of the stick lever and the delayed operation component works in a delayed mode. For that reason, the servo unit is operated in a two-step mode or the operation for the delayed operation amount is reversed to the operation of the stick lever. As a result, the fuselage of a manipulated body cannot be stably controlled because its unsteady and unstable attitude.

SUMMARY OF THE INVENTION

The present invention is made to solve the above-mentioned problems.

Moreover, the objective of the invention is to provide a radio control device for model vehicles that can stably control a manipulated body according to an operator's direction when the rudder for correction is quickly moved following the operation of a stick lever even during a delay operation The objective of the present invention is achieved by a radio control device suitable for model vehicles, comprising storage means for storing plural types of characteristic data, the plural types of characteristic data representing servo outputs of servo devices for a manipulated body to an operation amount of a stick lever; switching means for selectively switching the plural types of characteristic data according to the operation status of the manipulated body; a transmitter for generating control signals from the characteristic data selectively switched by the switching means, the control signals containing data representing servo output data corresponding to an operation amount of the stick lever; a receiver mounted on the manipulated body, for controlling the output of each of the servo devices according to control signals from the transmitter; and output variable means for varying the servo output from each of the servo devices with respect to a neutral position of the stick lever; the transmitter having arithmetic processing means that delays and transmits an offset amount due to the output variable means when the stick lever is not operated over a set value and when the switching means switches the characteristic data and that interrupts the delay operation when the stick lever is operated over the set value during the delay operation and then transmits the servo output of each of the servo devices according to an operation amount of the stick lever.

In the radio control device as defined according to the present invention, plural types of characteristic data are stored representing servo outputs of plural servo devices of the manipulated body with respect to an operation amount of a sole stick lever; and the switching means selectively switches any one of the plural types of the characteristic data.

Moreover, in the radio control device according to the present invention, the arithmetic processing means recalculates servo output of a corresponding servo device when the stick lever is excessively operated over a set value during the delay operation, the servo output containing an operation amount of the stick lever and a variable amount by the output variable means.

BRIEF DESCRIPTION OF THE DRAWINGS

This and other objects, features, and advantages of the present invention will become more apparent upon a reading of the following detailed description and drawings, in which:

FIG. 6(*b*) is a diagram illustrating a pitch servo output-value characteristic to a stick on hovering;

FIG. 6(*c*) is a diagram illustrating a servo output-value characteristic of pitch/rudder mixing to a stick on hovering;

FIG. 7(*b*) is a diagram illustrating a pitch servo output-value characteristic to a stick on a loop or stall and turn performance in the sky;

FIG. 7(*c*) is a diagram illustrating a servo output-value characteristic of pitch/rudder mixing to a stick on a loop or stall and turn performance in the sky;

FIG. 8(*b*) is a diagram illustrating a pitch servo output-value characteristic to a stick on a roll performance in the sky;

FIG. 8(*c*) is a diagram illustrating a servo output-value characteristic of pitch/rudder mixing to a stick on a roll performance in the sky.

DETAILED DESCRIPTION OF THE PREFERRED EMBODIMENTS

An embodiment of the present invention will be described below with reference to the attached drawings.

Figure 1:
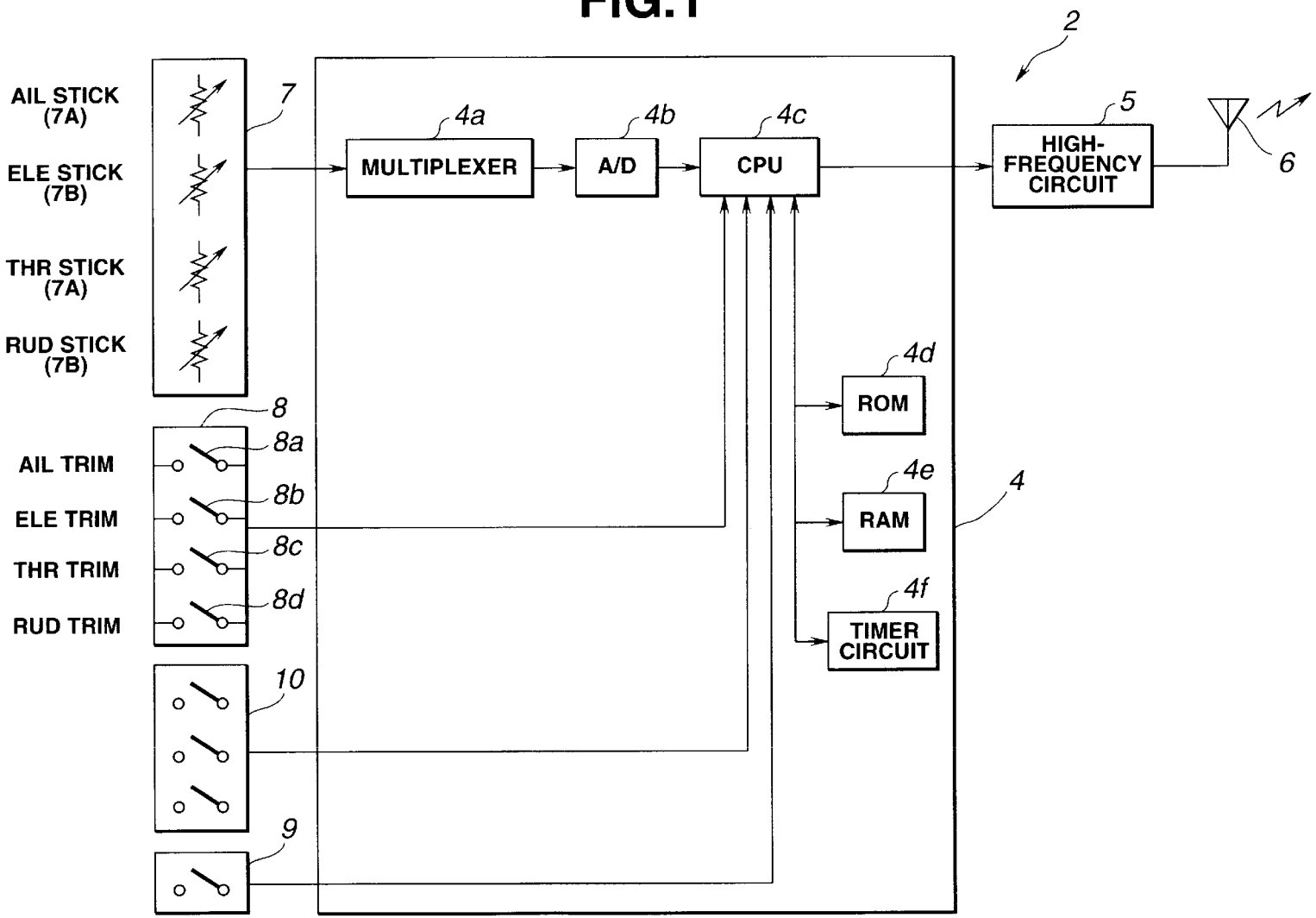
FIG. 1 is a block diagram schematically illustrated the configuration of a transmitter in a radio control device for model aircraft, according to an embodiment of the present invention.
Figure 2:
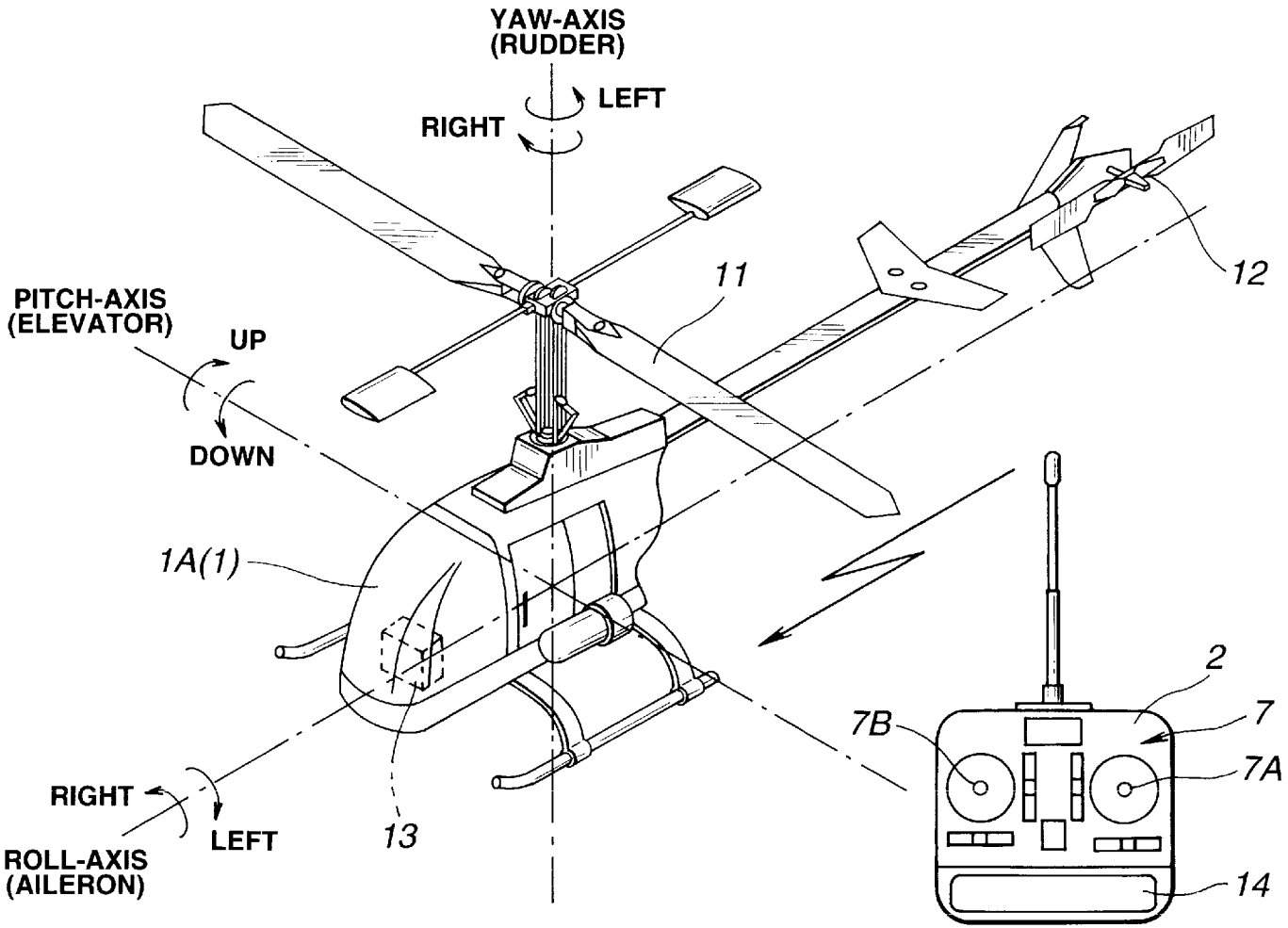
FIG. 2 is a perspective view illustrating a model helicopter acting as a manipulated body mounting a receiver, and a transmitter.

FIG. 1 is a block diagram showing the schematic configuration of the transmitter for a radio control device for model aircraft, according to an embodiment of the present invention. FIG. 2 is a perspective view illustrating a transmitter and a model helicopter being a manipulated body on which a receiver is mounted.

The radio control device has a transmitter 2 that high-frequency modulates control signals for remotely-control a manipulated body 1 and then generates the modulated signals as radio waves.

As shown in FIG. 1 or FIG. 2, the transmitter 2 consists of input means 3, arithmetic process means 4, a high-frequency circuit 5 and an antenna 6. The input means 3 includes a stick lever unit 7, a trim switch 8 acting as output variable means, a changeover switch 9 acting as output switching means and an edit key 10 acting as setting means.

Here, the case where a helicopter is remotely controlled as the manipulated body 1 is described below. As shown in FIG. 2, the helicopter 1A has two rotors: a main rotor 11 and a tail rotor (rudder) 12. In order to execute various kinds of flight, two stick levers 7A and 7B on the stick lever unit 7 shown in FIG. 2 are operated, so that the pitch angles of the two rotors 11 and 12 are varied.

In further description, when the right stick lever 7A of the stick unit (FIG. 2) is moved vertically (corresponding to the THR stick of FIG. 1), the engine power can be controlled by operating the throttle and the carburetor of the engine. At the same time, the angle (pitch) of the main rotor 11 can be increased or decreased.

For example, when the stick lever 7A is moved from the lower position to the upper position, the engine power and the pitch of the main rotor 11 increase, so that the helicopter 1A goes up. An increase or decrease in pitch is called "corrective pitch". The rudder is called "aileron (or pitch control)"

Referring back to FIG. 2, when the right stick lever 7A of the stick unit 7 is moved horizontally (corresponding to the AIL stick of FIG. 1), the horizontal movement of the helicopter 1A can be controlled. By operating the stick lever 7A, the pitch angle of the main rotor 11 is periodically varied (cyclic pitch control). Thus, the rotating plane is tilted to the direction where the stick lever 7A is moved. This movement is referred to as "roll axis". The rudder is referred to as "aileron".

Referring to FIG. 2, when the left stick lever 7B (corresponding to the ELE stick of FIG. 1) of the stick unit7 is moved vertically, the front and rear movement of the helicopter 1A can be controlled. When the stick lever 7B is moved upward (in the front direction), the fuselage advances (or descends). When the stick lever 7B is moved downward (toward the operator), the fuselage retreats (or ascends). In further explanation, the fuselage advances or retreats by tilting the rotating plane of the main rotor 11 under the cyclic pitch control. The front or rear tilt is referred to as "pitch axis". The rudder is referred to as "elevator".

When the left stick lever 7B (corresponding to the RUD stick of FIG. 1) of the stick unit 7 in FIG. 2 is moved right and left, the left or right movement of the nose of the helicopter 1A can be controlled. When the stick lever 7B is tilted right, the nose turns to the right. When the stick lever 7B is tilted left, the nose turns to the left.

In the case of the helicopter (or a single rotor helicopter) with the main rotor 11 and the tail rotor 12, the left or right movement of the nose can be controlled by operating the stick lever 7B and by increasing or decreasing the pitch of the tail rotor 12. The right or left movement is referred to as "yaw axis". The rudder is referred to as "rudder".

The trim switch 8 acting as output variable means consists of four switches including an AIL trim switch 8*a*, an ELE trim switch 8*b*, a THR trim switch 8*c* and a RUD trim switch 8*d*. The switches 8*a*, 8*b*, 8*c* and 8*d* respectively correspond to up, down, right and left direction movements of each of the two stick levers 7A and 7B of the stick unit 7. Each of the trim switches 8*a* to 8*d* varies the resistance value of a variable resistor to a neutral position where the stick lever 7A and 7B are not operated. Thus, the mixing amount can be varied to adjust the servo output of the servo unit of the manipulated body 1.

The changeover switch 9 acting as switching means is attached to the transmitter 2. An operator can select three flight modes (a hovering mode, a first flight mode and a second flight mode).

Figure 6A:
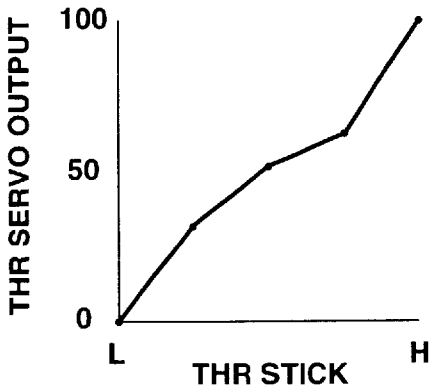
FIG. 6(*a*) is a diagram illustrating a throttle servo output-value characteristic to a stick on hovering.
Figure 6B:
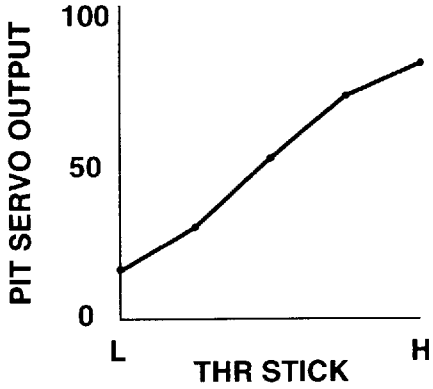
Figure 6C:
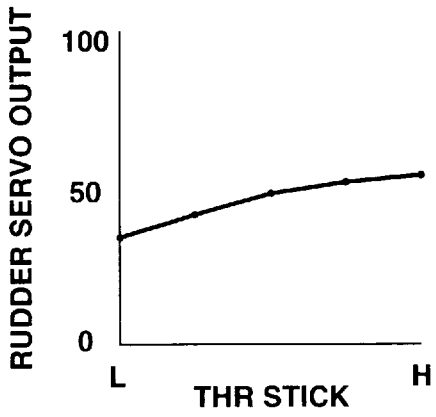

In further explanation, when the changeover switch 9 selects a hovering mode, characteristic curve data (data regarding the throttle curve and the pitch curve) shown in FIGS. 6(*a*) and 6(*b*), previously stored in the storage means of the arithmetic process means 4, are selected and become usable.

When the changeover switch 9 selects the first flight mode, the characteristic curve data (data regarding the throttle curve and the pitch curve), previously stored in the storage means of the arithmetic process means 4, is selected and becomes usable. The characteristic curve data represents the servo output corresponding to the operation amount of the stick lever 7A shown in FIGS. 7(*a*) and 7(*b*).

When the changeover switch 9 selects the second flight mode, the characteristic curve data (data regarding the throttle curve and the pitch curve), previously stored in the storage means of the arithmetic process means 4, is selected and becomes usable. The characteristic data represents the servo output corresponding to the operation amount of the stick lever 7A shown in FIG. 8(*a*) and 8(*b*).

The edit key 10 acting as setting means is formed of plural keys attached to the transmitter 2. In concrete, a setting image is displayed on the display screen of the display 14 of the transmitter 2. The edit key 10 is operated when the rate (0 to 100%) of the delay amount is set. The edit key 10 also is operated to vary point data of the characteristic curve showing the servo output values according to the operation amount of the stick levers 7A and 7B and specifically to vary the servo output values shown with black dots of FIGS. 6 to 8. The edit key 10 sets "valid" or "invalid" of the mixing operation operating plural servo units with a single stick lever 7A (or 7B).

When a pitch to rudder mixing is set "valid" by operating the edit key 10, the characteristic curve data (or data regarding the pitch to rudder mixing curve shown in FIG. 6(*c*), 7(*c*) or 8(*c*) corresponding to each mode) is selected and becomes usable. The characteristic data represents the servo output value corresponding to an operation amount of the stick lever 7A (or 7B) selected by the changeover switch 9.

Figure 7A:
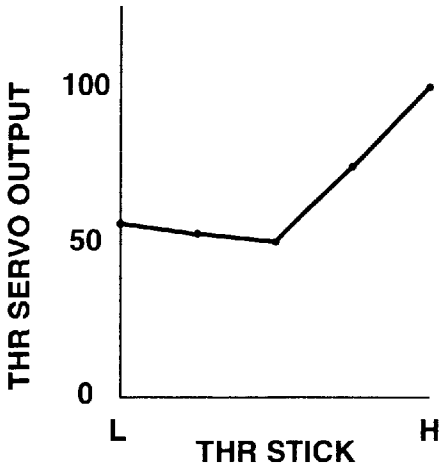
FIG. 7(*a*) is a diagram illustrating a throttle servo output-value characteristic to a stick on a loop or stall and turn performance in the sky.
Figure 7B:
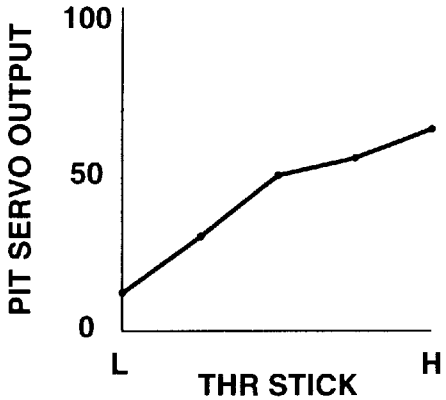
Figure 7C:
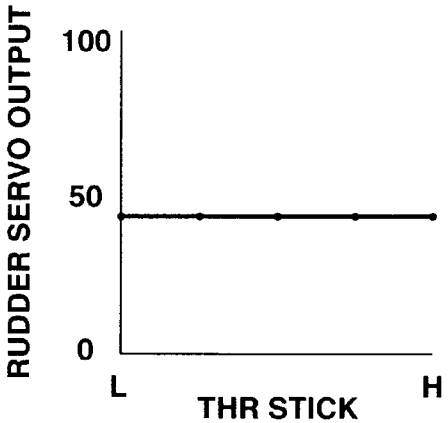
Figure 8A:
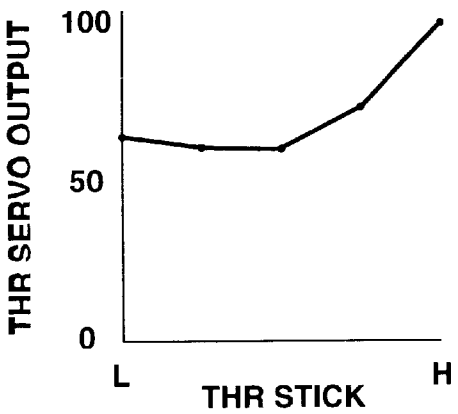
FIG. 8(*a*) is a diagram illustrating a throttle servo output-value characteristic to a stick on a roll performance in the sky.
Figure 8B:
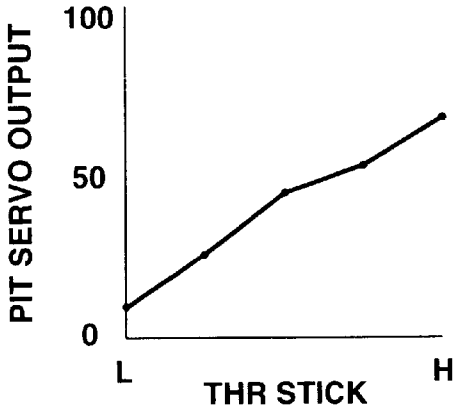
Figure 8C:
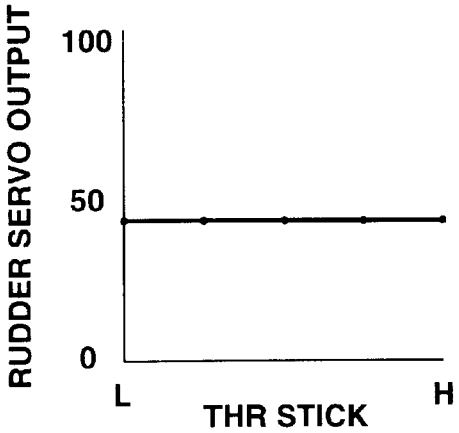
Figure 9:
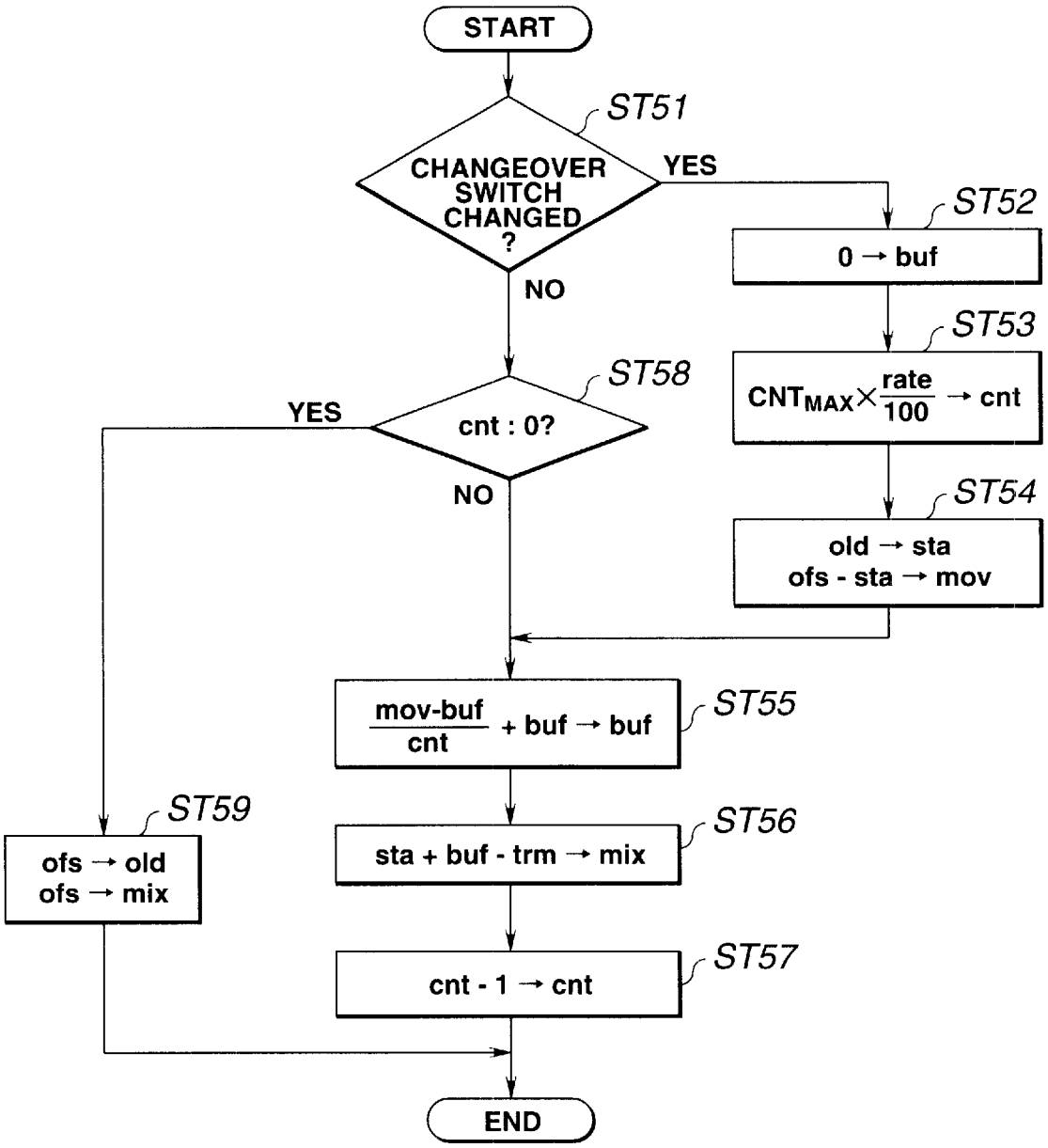
FIG. 9 is an operational flow chart explaining the function of delaying an operation by an offset of a mixing amount due to a trim switch upon switching operation of a changeover switch.

In each mode, the storage means in the arithmetic process means, for example, can previously store data regarding the vertical movement of the stick lever 7A (corresponding to the THR stick of FIG. 1) shown in FIGS. 6 to 8 as well as data regarding movements in other directions of each of the stick levers 7A and 7B (corresponding to the AIL stick, the ELE stick and the RUD stick). Thus, the servo output values corresponding to the operation amounts of the stick lever 7A or 7B can be selectively switched by operating the changeover switch 9.

The arithmetic process means 4, for example, is formed of a one-chip microcomputer. The one-chip microcomputer consists of a multiplexer 4*a* acting as switching and selecting means, an A/D conversion circuit 4*b* acting as data means, a CPU 4*c* acting as control means, a ROM (storage means) 4*d* which stores process program executed by the CPU 4*c* and characteristic curve data shown in FIGS. 6 to 8, a RAM 4*e* acting as storage means which sequentially updating and storing data and arithmetic results necessary for operation of the CPU 4*c*, and a timer circuit 4*f* acting as time piece means.

The multiplexer 4*a* acting as a switching and selecting means is a multi-contact electronic switch. The multiplexer 4*a* selects the THR stick, the AIL stick, the ELE stick or the RUD stick of FIG. 1. The A/D conversion circuit 4*b* receives a resistance value (an analog signal) of a variable resistor varied according to the operation amount of a selected stick lever 7A (or 7B).

The A/D conversion circuit 4*b* acting as a data conversion circuit converts the resistance value according to the operation amount of each of the stick levers 7A and 7B input from the multiplexer 4*a* into a digital signal and then outputs the converted signal to the CPU 4*c*.

The CPU 4*c* acting as a control circuit is formed of, for example, a microprocessor including internal counters. The CPU 4*c* receives signals from the A/D conversion circuit 4*b*, signals from the trim switch 8, signals from the changeover switch 9 and signals from the edit key 10. The CPU 4*c* variously changes the type of setting according to the process program stored in the ROM 4*d* (storage means) based on the above-mentioned signals. The CPU 4*c* judges whether there is the operation of each of the stick levers 7A and 7B. Furthermore, the CPU 4*c* controls a delay amount calculation a mixing amount calculation, a servo operational amount calculation and the outputting of an operation signal corresponding to an operation amount of each of the stick levers 7A and 7B (including a trim operation amount of the trim switch 8 and an offset of a mixing amount at the switching time of the changeover switch 9).

Figure 5:
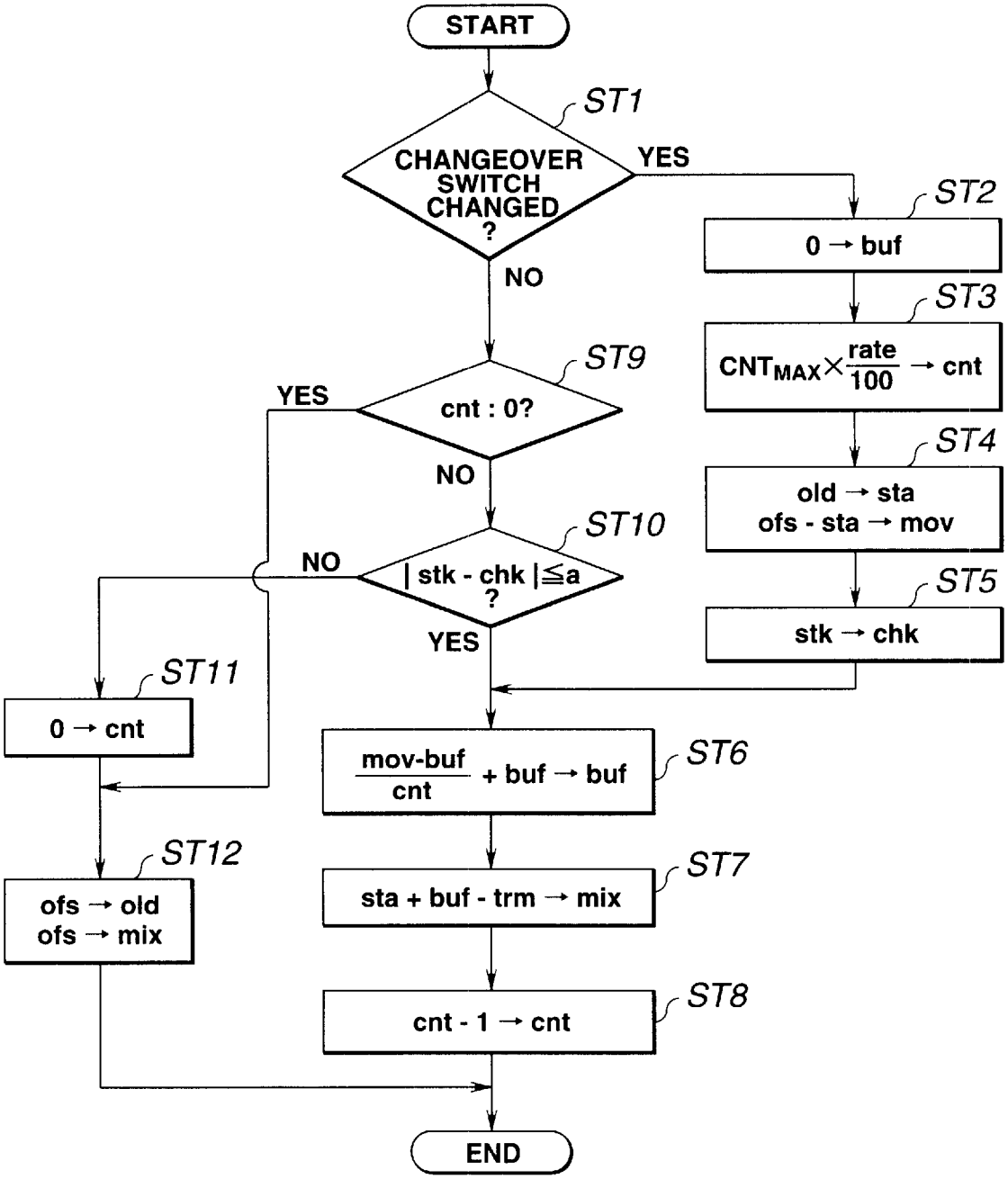
FIG. 5 is a flow chart illustrating the mixing arithmetic process shown in FIG. 3.

The timer circuit 4*f* measures the time period for which the CPU 4*c* performs the mixing arithmetic process and servo output value arithmetic process shown in FIGS. 5 and 6 every frames (e.g. every 30 msec). The timer circuit 4*f* outputs an interrupt signal to the CPU 4*c* at intervals of the time corresponding to one-bit width of a serial signal which is output from the CPU 4*c* to the high-frequency circuit 5.

Thus, the CPU 4*c* is outputs data for each channel containing an internally calculated operation amount of a servo unit as a serial signal (operation signal) of a base band with a fixed frame length, to the high-frequency circuit 5.

The high-frequency circuit 5 high-frequency modulates (e.g. FM modulates) data for each channel containing the servo operation amount from the arithmetic process circuit 4 and then radiates the modulated signal as radio waves through an antenna 6.

In the redio control device with the above-mentioned configuration, when the stick lever 7A (or 7B) of the transmitter 2 is operated, the signal corresponding to the operation amount of the stick lever 7A (or 7B) is high-frequency modulated and then radiated the resultant signal as radio waves. The receiver 13 receives radio waves from the transmitter 2 and then demodulates it into data for each channel. Thus, the demodulated signal drives the servo unit.

Figure 3:
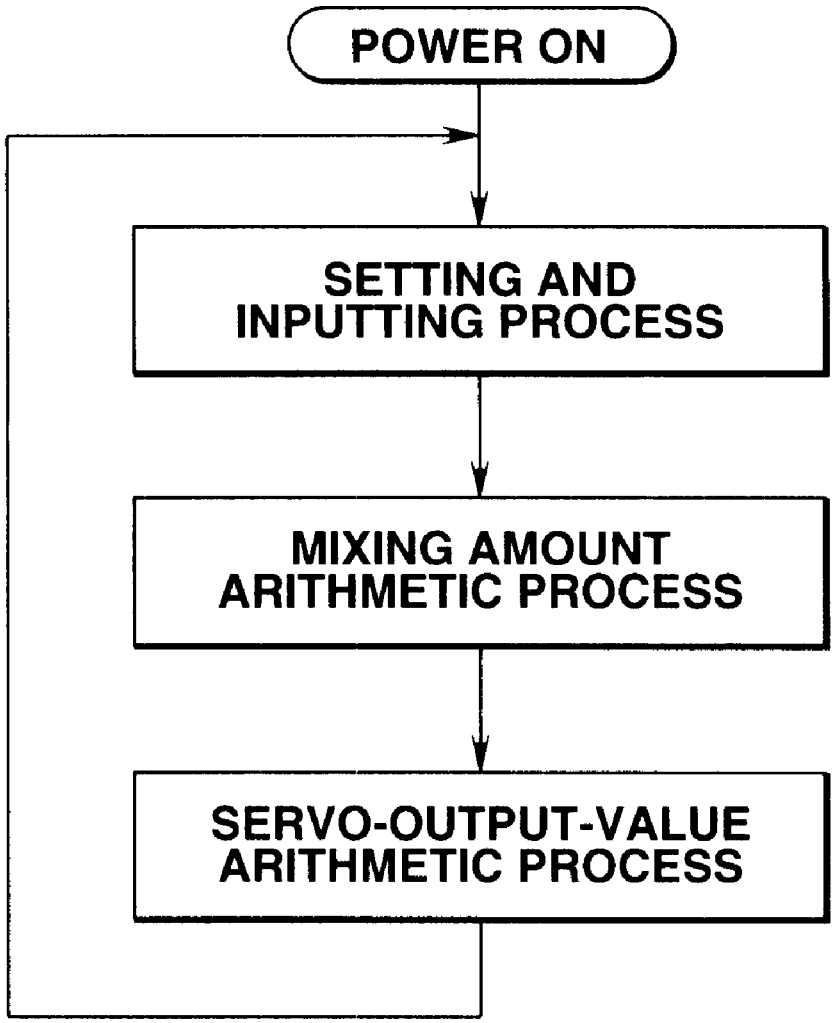
FIG. 3 is a flow chart schematically illustrating the operation of the transmitter of the model aircraft radio control device, according to the present invention.

FIG. 3 shows a flow chart schematically illustrating the whole operation of the transmitter 2 to remotely control the manipulated body 1.

As shown in FIG. 3, the process of the transmitter 2 is roughly divided into a setting and inputting process, a mixing amount arithmetic process and a servo output value arithmetic process. When the power source is turned on, the transmitter 2 executes the process program every predetermined period of time.

The setting and input process is arbitrarily performed according to an operator's desire. For example, when the edit key 10 is operated, the servo outputs corresponding to each of the stick levers 7A and 7B (e.g. see five points shown with black dots in FIGS. 6 to 8) are pointed on the display screen of the display 14 of the transmitter 2 and thus can be variably set on flight condition basis. Moreover, the presence or absence of the delay amount or mixing amount can be set through the operation of the edit key 10 while data is being checked on the display screen.

Figure 4:
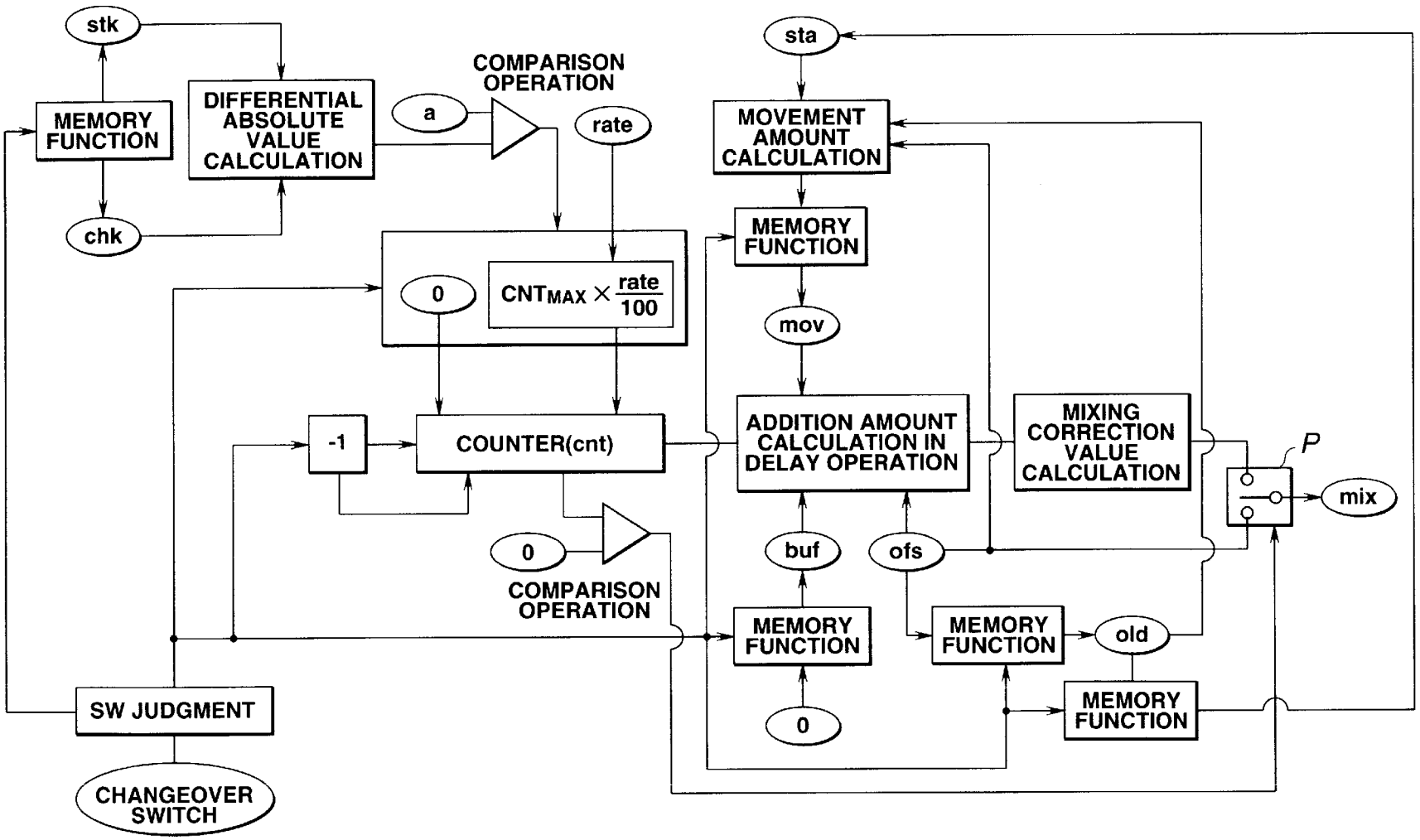
FIG. 4 is a functional block diagram illustrating the mixing arithmetic process shown in FIG. 3.

In the mixing amount arithmetic process, the mixing amount of the trim switch 8 containing the delay arithmetic operation is calculated according to the function block diagram of FIG. 4 and the flow chart of FIG. 5. This mixing amount arithmetic process is executed at intervals of one frame of e.g. 30 milliseconds during which the timer circuit 4*f* monitors.

The memory function of FIG. 4 means that data is temporarily stored into the RAM 4*e* in the arithmetic process means 4. The element P shown in FIG. 4 depicts as a switch function where either the offset mixing data ofs or the mixing correction value calculation is selected according to whether the counter initial value cnt is 0 or not 0.

The presence or absence of the operation of the changeover switch 9 is detected to select a set value meeting a flight condition (ST1). When the changeover switch 9 is switched (ST1-Yes), the change amount buf of the servo unit is cleared to zero during the delay operation (ST2). Thereafter, the initial value (movement amount) cnt of a counter corresponding to a delay amount is set (ST3). The initial value cnt of the counter is calculated by the formula $CNT_{MAX}\times(rate/100)$, where $CNT_{MAX}$ is a count initial value with a delay amount of 100% (maximum value) and rate is the rate of a delay amount.

Next, the offset mixing data (the mixing amount of the trim switch) prior to one frame is set to the position sta of a servo unit at the beginning time of delay operation (ST4). The position sta is subtracted from the offset mixing data ofs. The resultant value is set as a servo movement amount mov in a delay operation (ST4). The operation amount stk of a stick lever is set as an operation amount chk of a stick lever at a delay starting time (ST5). The set value is held for the next frame.

Next, the remaining movement amount of a servo unit is calculated based on the difference between the current position of the servo unit and a target position where the servo unit originally comes. Referring to the flow chart shown in FIG. 5, the formula, (mov−buf)/cnt+buf, is calculated, where cnt is a counter initial value, mov is a movement amount of a servo in a delay operation, and buf is a change amount of a servo unit in a delay operation. The resultant value is set to the change amount buf (ST6).

Then, the remaining amount buf of a servo unit is added to a movement value sta of the servo unit at a delay starting time. Then, the trim amount trm is subtracted from the resultant sum. The resultant value is set as the mixing amount mix (ST7). Thereafter, the counter initial value cnt is decremented by 1 (ST8). Thus, the one frame process has been completed.

In the above-mentioned operation, if there is no switching operation of the changeover switch 9 (ST1-No), it is judged whether the counter initial value cnt is 0, that is, whether the delay operation has been completed (ST9). When it is judged that the counter initial value cnt is not 0 (ST9-No) and that the stick lever has not been operated when the absolute value |stk−chk| is less than the set value a, the flow goes to the step ST6. The absolute value |stk−chk| is obtained by subtracting the stick lever operation amount chk at a delay starting time from the stick lever operation amount stk (ST10-Yes).

When it is judged that the absolute value |stk−chk| is larger than the set value a, the stick lever 7A (or 7B) bas been operated (ST10-No) and the counter initial value cnt is cleared to 0 (ST11). The offset mixing data ofs is set as old offset mixing data prior to one frame (ST12) and is output as the mixing amount mix (ST12). If the counter initial value cnt is 0 in the step ST9 (ST9-Yes), the flow goes to the step ST12.

The set value a, which judges whether the stick lever 7A (or 7B) is operated, is set to a threshold value. When the absolute value |stk−chk| is less than the set value a (i.e., the threshold value), the stick lever 7A (or 7B) has not been operated. If necessary, the set value a is changed by the edit key 10 acting as a setting means.

When the mixing amount mix is calculated in the mixing amount arithmetic process, the servo output value arithmetic process is performed. In the servo output value arithmetic process, the mixing amount mix calculated in the mixing amount arithmetic process is added to the stick operation amount stk and the trim operation amount trm. The added value is calculated as the servo operation amount srv. The servo output value arithmetic process is executed every time, with one frame of, e.g. 30 milliseconds.

According to the above-described embodiment, when the stick lever 7A (or 7B) is operated at a set value a or more during the delay operation of the servo unit (e.g. servo motor), the steps ST2 to ST8 shown in FIG. 5 are omitted but the delay operation is interrupted. Immediately, the servo unit is operated following the operation of the stick lever 7A (or 7B). That is, when the stick lever 7A (or 7B) is operated at the set value a or more during the delay operation, the servo output to a corresponding servo unit is recalculated. The servo output corresponds to the operation amount of the stick lever 7A (or 7B) and the trim operation amount of the trim switch 8. Thus, the servo unit is immediately operated to the calculated position. Thus, the rudder can be quickly corrected with the stick lever 7A (or 7B) during the delay operation.

Even if the stick lever 7A (or 7B) is operated during the delay operation, the two step operation in the prior art is not performed. Moreover, there is not that the direction of the delay operation is not opposite to the operation direction of the stick lever 7A (or 7B). For that reason, it can be avoided that the fuselage becomes unstable by the operation of the stick lever 7A (or 7B) during the delay operation, so that aircraft can be stably controlled.

As clearly understood from the above description, according to the present invention, when the stick lever is operated during a delay operation of the servo unit, the delay operation is interrupted. Thus, the servo unit can be immediately operated following the operation of the stick lever. As a result, the rudder can be quickly corrected even in the delay operation by operating the stick lever.

Moreover, even when a stick lever is operated during the delay operation, it does not occur that the two step operation is performed and that the direction of the delay operation is reverse to the operation direction of the stick lever. For that reason, the fuselage can be stably operated without rolling.

What is claimed is:

1. A radio control device suitable for model vehicles, comprising:

storage means for storing plural types of characteristic data, said plural types of characteristic data representing servo outputs of servo devices for a manipulated body corresponding to an operation amount of a stick lever;

switching means for selectively switching said plural types of characteristic data according to an operation status of said manipulated body;

a transmitter for generating control signals from said characteristic data selectively switched by said switching means, said control signals containing data representing servo output data corresponding to the operation amount of said stick lever;

a receiver mounted on said manipulated body for controlling the output of each of said servo devices according to control signals for said transmitter; and output variable means for varying the servo output from each of said servo devices with respect to a neutral position of said stick lever;

said transmitter having arithmetic processing means that delays and transmits an offset amount due to said output variable means when said stick lever is not operated over a set value and when said switching means switches said characteristic data, said arithmetic processing means interrupts said delay operation when said stick lever is operated over said set value during said delay operation and instead transmits the servo output of each of said servo devices according to an operation amount of said stick lever.

2. A radio control device as defined in claim 1, wherein plural types of characteristic data are stored representing servo outputs of plural servo devices of said manipulated body with respect to an operation amount of a second stick lever and wherein said switching means selectively switches any one of said plural types of said characteristic data.

3. A radio control device as defined in claim 1, wherein said arithmetic processing means recalculates servo output of a corresponding servo device when said stick lever is excessively operated over a set value during said delay operation, said servo output containing an operation amount of said stick lever and a variable amount by said output variable means.

4. A radio control device as defined in claim 2, wherein said arithmetic processing means recalculates servo output of a corresponding servo device when said second stick lever is excessively operated over a set value during said delay operation, said servo output containing an operation amount of said second stick lever and a variable amount by said output variable means.

5. A radio control device suitable for a model vehicle, comprising:

a memory configured to store a plurality of types of characteristic data, said plurality of types of characteristic data representing servo outputs of servo devices for the model vehicle corresponding to an operation amount of a stick lever;

a changeover switch configured to selectively switch said plurality of types of characteristic data according to an operation status of said model vehicle;

a transmitter configured to generate control signals from said characteristic data selectively switched by said changeover switch, said control signals containing data representing servo output data corresponding to the operation amount of said stick lever;

a receiver mounted on said model vehicle configured to control the output of each of said servo devices according to control signals from said transmitter; and trim switches configured to vary the servo output from each of said servo devices with respect to a neutral position of said stick lever;

said transmitter having an arithmetic processor configured to delay and transmit an offset amount due to said trim switches when said stick lever is not operated over a set value and when said changeover switch switches said characteristic data, said arithmetic processor interrupts said delay operation when said stick lever is operated above said set value during said delay operation and instead transmits the servo output of each of said servo devices according to an operation amount of said stick lever.

6. A radio control device as defined in claim 5, wherein the plurality of types of characteristic data are stored representing servo outputs of a plurality of servo devices of said model vehicle with respect to an operation amount of a second stick lever; and wherein said changeover switch selectively switches any one of said plurality of types of said stick data.

7. A radio control device as defined in claim 5, wherein said arithmetic processor recalculates servo output of a corresponding servo device when said stick lever is excessively operated over a set value during said delay operation, said servo output containing an operation amount of said stick lever and a variable amount by said trim switches.

8. A radio control device as defined in claim 6, wherein said arithmetic processor recalculates servo output of a corresponding servo device when said second stick lever is excessively operated over a set value during said delay operation, said servo output containing an operation amount of said stick lever and a variable amount by said trim switches.

9. A method for the radio control of a model vehicle comprising:

selectively switching to one of a plurality of types of characteristic data according to an operation status of said model vehicle;

performing a delay operation using an arithmetic processor when switching to one of said plurality of types of characteristic data to prevent an attitude of said model vehicle from becoming unstable;

interrupting said delay operation when at least one stick lever is operated above a range of a set value; and transmitting a servo output for each servo device according to an operation amount of said at least one stick lever when the step of interrupting is performed.

* * * * *